United States Patent [19]

Ezra

[11] Patent Number: 5,046,883

[45] Date of Patent: Sep. 10, 1991

[54] CONNECTORS FOR SPACE FRAME STRUCTURES

[76] Inventor: Yehoshua B. Ezra, Rehov Rupin 14, Kfar Saba, Israel

[21] Appl. No.: 450,193

[22] Filed: Dec. 13, 1989

[51] Int. Cl.[5] ..... F16B 9/00

[52] U.S. Cl. ..... 403/171; 403/176; 403/217

[58] Field of Search ..... 403/170, 171, 176, 172, 403/217, 174, 178

[56] References Cited

U.S. PATENT DOCUMENTS

| | | | |
|---|---|---|---|
| 3,914,063 | 10/1975 | Papayoti | 403/176 X |
| 4,370,073 | 1/1983 | Ohme | 403/172 |
| 4,473,986 | 10/1984 | Zeigler | 403/171 X |
| 4,483,118 | 11/1984 | Betschart | 403/171 X |
| 4,838,003 | 6/1989 | Zeigler | 403/171 X |

FOREIGN PATENT DOCUMENTS

| | | | |
|---|---|---|---|
| 2904330 | 8/1979 | Fed. Rep. of Germany | 403/176 |

*Primary Examiner*—Peter M. Cuomo
*Attorney, Agent, or Firm*—Benjamin J. Barish

[57] ABSTRACT

A node-connector for a space frame structure includes a base plate divided into a plurality of equal sections by a corresponding plurality of double-wall partitions joined to the base plate and to each other at the center of the base plate and extending perpendicularly to the base plate. Each of the double-wall partitions includes two parallel walls spaced from each other and formed with aligned openings for pivotally mounting one structural member of a first group in the space between the two walls of the respective partition. Each of the plurality of sections of the base plate is further formed with an opening for pivotably mounting one structural member of a second group.

11 Claims, 2 Drawing Sheets

CONNECTORS FOR SPACE FRAME STRUCTURES

BACKGROUND OF THE INVENTION

The present invention relates to node-connectors for space frame structures, and also to space frame structures including such node-connectors.

The invention is particularly applicable in space frame structures for supporting rigid roofs of various configurations, and is therefore described below with respect to this application. It will be appreciated, however, that the invention could be used in many other applications, including other forms of building structures as well as erector toy sets and the like.

Space frame structures are widely used for supporting roofs of various building structures, for example in gymnasiums, arenas, airports, hangars, office buildings, museums, hotels and hospitals. Such space frame structures include a plurality of structural members, such as tubes, to be mounted according to various configurations by the use of node-connectors which connect the ends of the structural members to form an open frame structure The space frame building technique generally needs fewer supporting columns than conventional building techniques, provide modularity with a high degree of flexibility in the building structure design, and permits assembly on the building site.

OBJECTS AND SUMMARY OF THE INVENTION

An object of the present invention is to provide a new node-connector for a space frame structure, which node-connector provides a number of important advantages over those presently used in such structures. Another object of the present invention is to provide a space frame structure including the novel node connector.

According to the present invention, there is provided a node-connector for a space frame structure comprising a flat base plate divided into a plurality of equal sections by a corresponding plurality of double-wall partitions joined to the flat base plate and to each other at the center of the flat base plate and extending perpendicularly to the flat base plate. Each of the double-wall partitions includes two parallel walls spaced from each other, and each is formed with a single opening. The single opening of each wall in each double-wall partition is aligned with the single opening in the other of the double-wall partition for pivotably mounting one structural member of a first group of structural members in the space between the two walls of the respective partition. Each of the plurality of sections of the flat base plate is further formed with an opening therethrough for pivotably mounting one structural member of a second group of structural members.

In the preferred embodiment of the invention described below, the base plate is divided into four equal sections by four double-wall partitions extending perpendicularly to each other and to the base plate, whereby the aligned openings through two of the partitions enable the mounting of two structural member of the first group to pivot about a first orthogonal axis, the aligned openings through the other two partitions enabling the mounting of two further structural members of the first group to pivot about a second orthogonal axis; and the openings through the base plate enabling the mounting of four structural members of the second group to pivot about the third orthogonal axis.

The invention also provides a space frame structure including a plurality of node-connectors as described above, a first group of structural members each pivotably mounted in the space between the two parallel walls in one partition by means of the aligned openings therethrough; and a second group of structural members each pivotably mounted in one of the openings in the base plate. In the described preferred embodiment, each of the structural members comprises a tube secured to one end of a lug, the opposite end of the lug being pivotably mounted in its respective opening in the double-wall partition or base plate.

One of the important advantages of the novel node-connector, and of the space frame structure including such connectors, is that the connectors permit a wide range of attachment angles of the structural members and firmly support them in their attached positions thereby further increasing the flexibility in design permitted by the use of such node-connectors.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
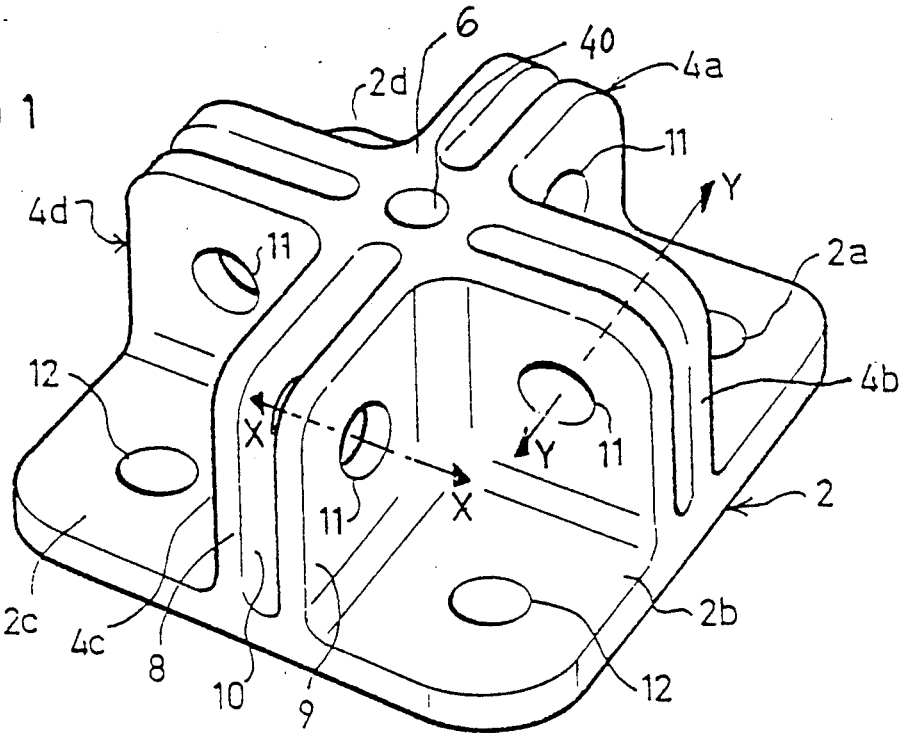
FIG. 1 is a three-dimensional view illustrating one form of node-connector constructed in accordance with the present invention.

With reference to FIG. 1, the node-connector therein illustrated comprises a flat base plate 2 divided into four equal coplanar sections 2*a*, 2*b*, 2*c* and 2*d*, by four double-wall partitions 4*a*, 4*b*, 4*c*, 4*d* joined to the base plate and to each other at a juncture portion 6 at the center of the base plate. The four double-wall partitions 4*a*–4*c* extend perpendicularly to the base plate 2 and also perpendicularly to each other at their juncture 6. Each of the partitions 4*a*–4*d* includes two parallel walls, e.g. walls 8, 9 with respect to partition 4*c*, spaced from each other by a space 10 and formed with aligned openings 11 at the centers of the respective walls. In addition, each of the sections 2*a*–2*d* of the base plate 2 is formed with a further opening 12, perpendicular to the common plane of the sections and in the center of its respective section.

Figure 2:
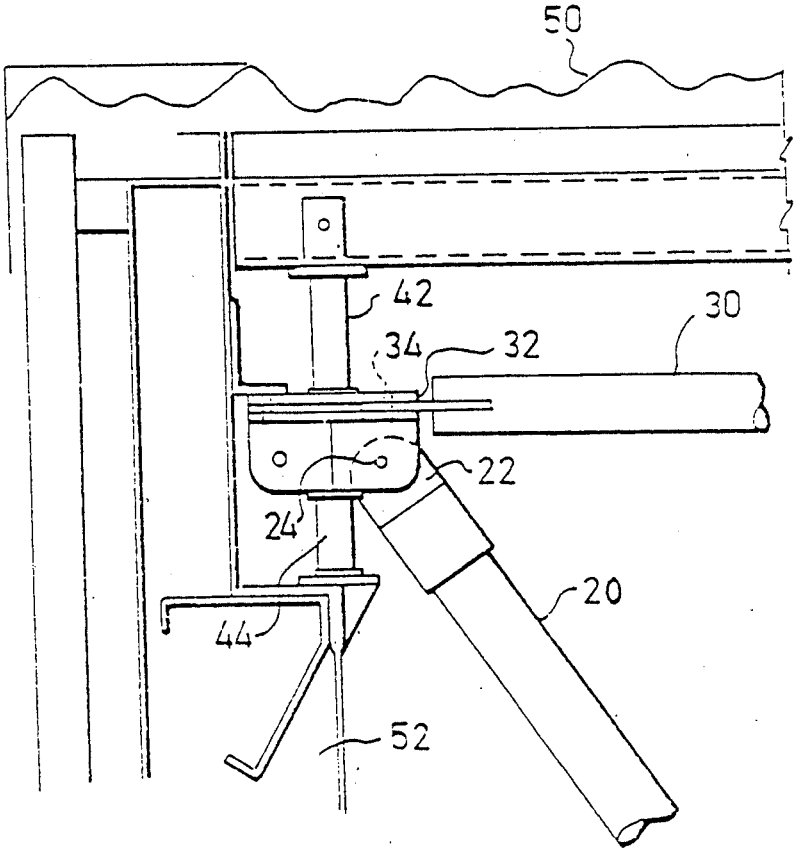
FIG. 2 illustrates a part of a frame structure including the node-connector of FIG. 1.

Each of the partitions 4*a*–4*d* is adapted to pivotably mount a structural member in the space between its two walls by the use of the aligned openings in the centers of the two walls. FIG. 2 illustrates the structural members in the form of tubes 20. Each tube is secured to one end of flat lugs 22. The opposite end of each lug is pivotably mounted in the space 10 between the two walls one of the partitions 4*a*–4*d* by a pin 24 passing through the aligned openings 11 in the two walls of the respective partition.

Thus, the node-connector illustrated in FIG. 1 is capable of pivotably mounting four such tubes 20 in the spaces 10 of its four double-wall partitions 4a–4d. The two tubes mounted by the two aligned double-wall partitions 4a, 4c, will be pivotable about one orthogonal axis, this being referred to as the X-axis; and the two tubes mounted in the other two aligned partitions 4b, 4d will be pivotable about a second orthogonal axis, namely the Y-axis.

As shown in FIG. 2, openings 12 in the center of each of the four sections 2a–2d of the base plate 2 are also used for pivotably mounting a second group of structural members, also in the form of tubes 30. Tubes 30 are secured to one end of a flat lug 32, the opposite end of the lug being pivotably mounted in the respective opening 12 by a pin 34. It will be appreciated that tubes 30 are thus pivotable about the third orthogonal axis, namely the Z-axis.

The center juncture 6 of the four double-wall partitions 4a–4d is formed with a bore 40 therethrough. This bore may also be used for attaching a structural member. In FIG. 2, this bore 40 is used for attaching a tubular member 42 projecting from one side of the node-connector, and a second tubular member 44 projecting from the opposite side.

It will thus be seen that the node-connector illustrated in FIG. 1 is capable of mounting four tubes 20 and four tubes 30, such that two of the tubes may be pivoted about the X-axis, two may be pivoted about the Y-axis, and the remaining four may be pivoted about the Z-axis. It will also be seen that the illustrated node-connector permits one or two additional structural members to be attached to the bore 40 through the juncture portion of the four double-wall partitions. These additional structural members, such as tubes 42, 44 (FIG. 2) also extend along the Z-axis. The latter members would normally be fixed and not pivotably mounted. The node-connector thus provides a high degree of flexibility as to the various frame structure designs which may be assembled in a modular manner using a plurality of such node-connectors and a plurality of the tubes (20, 30).

The base plate 2 and the double-wall partitions 4a–4d are formed together as an integral unit of the same material. Preferably, the material is cast metal, but may also be cast or injection-molded plastic.

FIG. 2 illustrates one node-connector according to FIG. 1 used in a frame structure for supporting a roof 50. The node-connector illustrated in FIG. 2 is in inverted position as compared to FIG. 1, its base plate 2 being located at the top of the connector. It will thus be seen that tubular member 44 fixed within center bore 40 and projecting below the node-connector may be used for supporting the node-connector on a vertical column 52, and the upper tubular member 42 projecting upwardly from the node-connector may be used for supporting the roof 50, while tubular members 20 and 30 provide the necessary frame and bracing structure for supporting the roof. The wide range of the permitted pivotable movements of the tubular members 20 and 30 provides a high degree of flexibility in the frame structure designs that may be provided according to the particular application.

Figure 3:
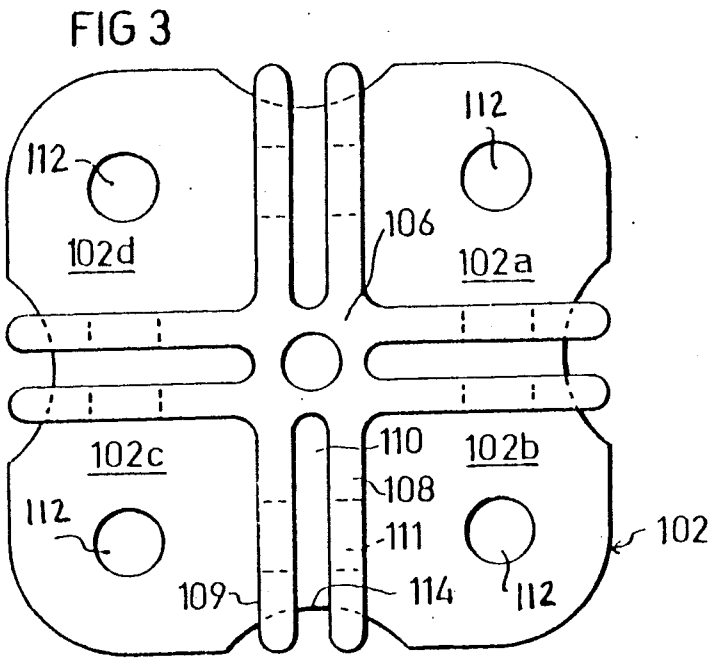
FIGS. 3 and 4 are plan and side elevational views, respectively, illustrating a modification in the construction of the node-connector of FIG. 1.
Figure 4:
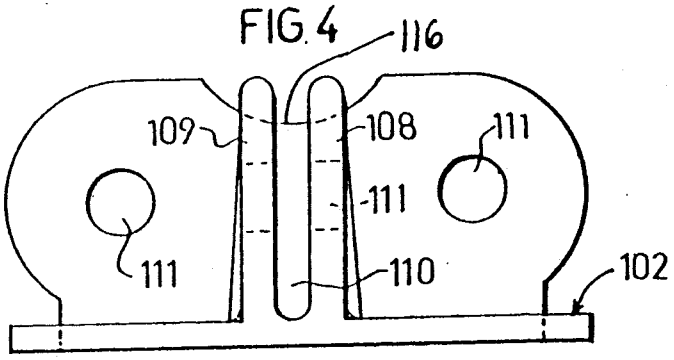

FIGS. 3 and 4 illustrate a modification in the construction of the node-connector of FIG. 1.

The node-connector of FIGS. 3 and 4 also include a flat base plate 102 divided into four equal sections 102a–102d by four double-wall partitions 104a–1104d joined to the base plate and to each other at the center of the base plate and extending perpendicularly to the base plate and to each other, as in FIG. 1. In addition, the two walls 108, 109 of each double-wall partition are also formed with aligned openings 111 for pivotably mounting four structural members, corresponding to the tubular members 20 in FIG. 2, two pivotable about the X-axis and two pivotable about the Y-axis; and the four sections 102a–102d of the base plate 102 are also formed with central openings 112 for pivotably mounting four additional structural members, corresponding to tubular members 30 in FIG. 2, about the Z-axis. As in FIG. 3, the center juncture 106 of the four double-wall partitions 104a–104d is formed with a bore 140, which may also be used for attaching a structural member.

In the modification illustrated in FIGS. 3 and 4, however, the base plate 102 is further formed with an inwardly curved recess 114 underlying each of the double-wall partitions, particularly underlying the space 110 between the two walls 108, 109 of the double-wall partition. In addition, the upper end of the juncture portion 106 of the four double-wall partitions are joined is similarly formed with an inwardly curved recess 116 in the space between the two walls of each partition. Recesses 114 and 116 increase the degree of pivotable movement permitted by the four structural members, (corresponding to tubes 20, FIG. 2) mounted in the spaces 110 between the two walls 108, 109 of each partition, thereby further increasing the flexibility of design and application permitted by the illustrated node-connector.

Figure 5:
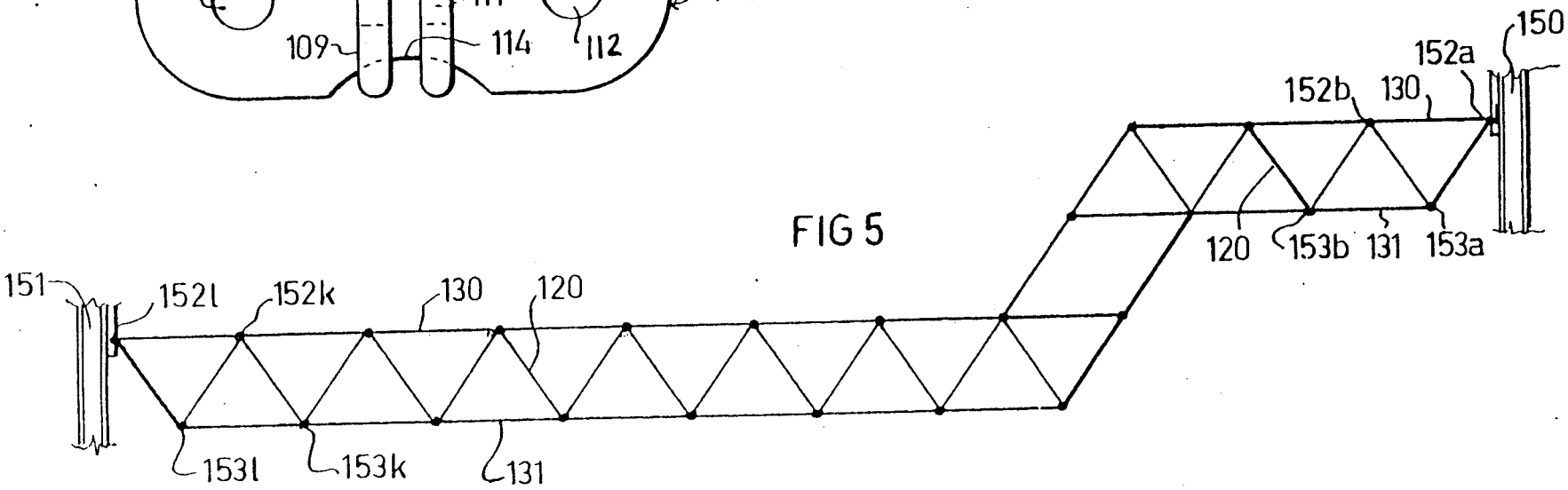
FIG. 5 is an elevational view illustrating a frame structure using a plurality of the node-connectors for supporting a roof.

FIG. 5 illustrates the use of the illustrated node-connectors for erecting a space frame structure for supporting a roof or the like. In the arrangement illustrated in FIG. 5, the space frame structure is supported between a pair of vertical columns, 150, 151 by an upper group of node-connectors 152a–1521 and a lower group of node-connectors 153a–1531. Thus, the upper node-connectors 152a–1521 are all interconnected by a plurality of horizontal tubular members 130, corresponding to tubular members 30 in FIG. 2, and the lower node-connectors 153a–1531 are interconnected by a similar plurality of horizontal tubular members 131, also corresponding to tubular members 30 in FIG. 2. In addition, the upper node-connectors 152a–1521 are interconnected with the lower node-connectors 153a–1531 by a plurality of diagonally-extending tubular members 120, corresponding to tubular members 20 in FIG. 2.

While the invention has been described with respect to two preferred embodiments, it will be appreciated that many other variations and applications of the invention may be made. For example, instead of providing four double-wall partitions, there could be provided a different number of partitions, e.g. eight, in order to further increase the flexibility in design permitted by the use of such node-connectors. In addition, the node-connectors and space frame structures may be used in making or supporting building structures other than roofs, e.g., scaffolding, walls and partitions, and may also be used in toy erector sets.

Many other variations, modifications and applications of the invention will be apparent.

What is claimed is:

1. A node-connector for a space frame structure comprising:

a flat base plate divided into a plurality of equal sections by a corresponding plurality of double-wall partitions joined to the flat base plate and to each other at the center of the flat base plate and extending perpendicularly to the flat base plate;

each of said double-wall partitions including two parallel walls spaced from each other and each formed with a single opening, the single opening of each wall in each double-wall partition being aligned with the single opening in the other wall of the double-wall partition for pivotably mounting one structural member of a first group of structural members in the space between the two walls of the respective partition;

said plurality of sections of said flat base plate being located in a common plane and each section being further formed with an opening therethrough perpendicular to said common plane for pivotably mounting one structural member of a second group of structural members.

2. The node-connector according to claim 1, wherein the flat base plate is divided into four equal sections by four double-wall partitions extending perpendicularly to each other and to the flat base plate, whereby the aligned openings through two of said partitions to enable the mounting of two structural member of said first group to pivot about a first orthogonal axis, the aligned openings through the other two of said partitions enabling the mounting of two further structural members of said first group to pivot about a second orthogonal axis; and the openings through the flat base plate enabling the mounting of four structural members of said second group to pivot about the third orthogonal axis.

3. The node-connector according to claim 1, wherein said flat base plate is formed with an inwardly curved recess in the space between the two walls in each of said partitions to increase the range of pivotable movement of said first group of structural members.

4. The node-connector according to claim 1, wherein the juncture of said partitions in the center of said flat base plate is formed with a bore for mounting a further structural member.

5. The node-connector according to claim 4, wherein the upper ends of said partitions at said juncture are formed with an inwardly curved recess to increase the range of pivotable movement of said first group of structural members.

6. The node-connector according to claim 1, wherein said single openings in the parallel walls of the double-wall partitions, and said openings in the plurality of sections of the flat base plate, are all formed centrally of their respective walls and section.

7. The node-connector according to claim 1, wherein said material is cast metal.

8. A space frame structure including:

a plurality of node-connectors each according to claim 1;

a first group of structural members each pivotably mounted in the space between the two parallel walls in each partition by means of the aligned openings therethrough;

and a second group of structural members each pivotably mounted in one of the openings in the flat base plate.

9. The space frame structure according to claim 8, wherein each of said structural members comprises a tube secured to one end of a lug, the opposite end of the lug being pivotably mounted in its respective opening in the partition or flat base plate.

10. The space frame structure according to claim 9, including a further tube mounted in a bore formed through the juncture of said partitions in the center of said flat base plate.

11. A roof supported by a space frame structure according to claim 8.

* * * * *